United States Patent [19]

Tatsuno

[11] 4,089,445

[45] May 16, 1978

[54] FUEL FILLING SYSTEM

[75] Inventor: Hiyoshi Tatsuno, Tokyo, Japan

[73] Assignee: Tokyo Tatsuno Co., Ltd., Tokyo, Japan

[21] Appl. No.: 686,439

[22] Filed: May 14, 1976

[30] Foreign Application Priority Data

Aug. 14, 1975 Japan ..... 50-98138

[51] Int. Cl.[2] ..... B67D 5/12

[52] U.S. Cl. ..... 222/538; 137/355.17; 137/355.21

[58] Field of Search ..... 222/74, 530, 538, 539; 248/58, 89, 323; 254/167, 168; 191/12 R, 12.2 R, 12.2 A; 137/355.16–355.28; 141/98, 279, 284

[56] References Cited

U.S. PATENT DOCUMENTS

| | | | |
|---|---|---|---|
| 2,893,422 | 7/1959 | Schiltz | 137/355.23 X |
| 2,896,659 | 7/1959 | Erickson | 222/530 X |
| 2,935,080 | 5/1960 | Klimek | 137/355.16 X |
| 3,309,064 | 3/1967 | Muller et al. | 254/168 |
| 3,797,703 | 3/1974 | Yamawaki et al. | 222/74 X |

*Primary Examiner*—Robert B. Reeves
*Assistant Examiner*—Fred A. Silverberg
*Attorney, Agent, or Firm*—Frank J. Jordan

[57] ABSTRACT

A nozzle suspended type fuel filling station comprising an under-ground fuel reservoir, a stationary conduit extending from the reservoir to a position above a passageway in the station, a flexible conduit connected to free end of the flexible conduit and having a dispensing nozzle, a motor for operating the flexible conduit to release and accommodate the same for vertical movement of the nozzle, a pump for pumping up the fuel from the reservoir to the nozzle, wherein the motors is accommodated in a relatively large size elongated hollow body. The motor is slidably arranged in the body, accommodated in a member movable in the body, or in the form of pulley members. The system can be conducted by a computer control system.

11 Claims, 28 Drawing Figures

FUEL FILLING SYSTEM

The present invention relates to a fuel filling system and more particularly to a gasoline or the like liquid fuel filling system or station for motor cars of the type that a nozzle for each fuel dispensing machine in the station is suspended through a flexible hose or conduit on any suitable structure over a passageway in the station, such as a beam or ceiling of the station building and can be moved vertically between an upper position not hindering passage of the motor cars and a lower position for fuel supplying.

The inventor has proposed such nozzle suspended type fuel filling system and obtained patents in various countries in the world inclusive of U.S. Pat. No. 3,395,723, British pat. specification No. 1,116,781, French Pat. No. 1,455,430, East German Pat. No. 67,926. The system as disclosed in the patents has great advantages, in comparison with prior systems wherein one or more gasoline pumps or fuel supplying posts are located on a so-called island, particularly in supplying fuel to the motor cars and effective use of limited area for the station but raises various practical problems. In the first place, in the prior systems, the island serves also as a guide way for the motor car drivers to approach a service area but, according to the nozzle suspended system, there is no guide way and thus a driver for the motor car to be serviced must drive his car under his judgement to approach a service area of a specified one of the dispensing machines with aiming a suspended nozzle thereof. It is not always easy for the driver to know accurately the service area, particularly when the nozzle lies at its upper position near the supporting structure such as ceiling of the station building. Secondarily, in the nozzle suspended system, the nozzle is attached, if necessary through a safety pipe coupling as disclosed in U.S. Pat. No. 3,741,521 granted to the present inventor to one end of the flexible conduit which is wound around a hose reel or drum, so that the nozzle can be raised or lowered by driving said reel. This arrangement requires a rotary or universal joint for connecting the other end of the flexible conduit to the free end of a stationary conduit and there is possible leakage of fuel from the joint portion. Thirdly, the nozzle is connected through a universal joint to the free end of a nozzle mounting member which has a nozzle holder thereon and the other end of which is connected to the free end of the flexible conduit through the safety pipe coupling and an electrical switch housing for manually controlling the winding of the flexible conduit, so that, in non-use, the nozzle can be held by the holder in such a manner that a tip end thereof directs upward to avoid any drop-out of the fuel remaining therein (FIG. 1 of U.S. Pat. No. 3,741,521) but this requires essentially an elbow type dual rotary joint for the nozzle arrangement to lower the handling efficiency of the nozzle.

The object of the present invention is, therefore, to provide an improved nozzle suspended type fuel filling system which obviates and overcomes the disadvantages or difficulties as referred to.

According to one of its aspects, the present invention provides a nozzle suspended type fuel filling system having a guide above a passageway, so that a driver can easily approach his intended service area by driving his car along the guide.

According to the present invention, the guide is formed as an elongated box-like body or container which accommodates at least a part of a flexible conduit having a dispensing nozzle at one end and a mechanism for releasing the flexible conduit accommodated in the body and taking the released flexible conduit into the body to lower and raise the dispensing nozzle, the other end of the flexible conduit being connected directly to a stationary conduit without using any rotary coupling or universal joint. The mechanism for handling or operating the flexible conduit to lower or raise the dispensing nozzle comprises a drive pulley to be rotated by a reversible motor and a pressure pulley driven by the flexible conduit contacting with the both pulleys, or comprises a stationary pulley and a spring-loaded movable pulley, said stationary and movable pulleys carrying the flexible conduit thereon.

The body as the guide for the motor car drivers can be divided into several compartments, for instance an upper compartment accomodating the flexible conduit and a lower compartment accommodating sliding member or a truck member which can be moved therein along the longitudinal axis of the body and accommodates at least one pulley for releasing from and tucking-up the flexible conduit into the upper compartment, so that the position of dispensing nozzle suspended from the free end of the flexible conduit can be varied by pulling the flexible conduit in the longitudinal direction of the body to move the sliding member or truck member so as to expand service area for fuel supplying. A brake means can be provided to prevent a possible hard impact of the sliding member or truck member with the both end surfaces of the lower compartment and to avoid a backward movement thereof due to the impact.

The body as guide may be made larger in size to accomodate two or more fuel dispensing units for various kinds of fuels which may be different in octane value, respectively, so that a service man or machine operator in the station can supply various fuels to motor cars to be serviced at the same position.

According to another aspect, the present invention is to provide a new type dispensing nozzle which can be attached to the free end of a flexible conduit without using any rotary coupling or joint.

According to a still another aspect, the present invention is to provide a nozzle suspended type fuel filling system related to a computer control system which automatically issues a sales slip and makes it easy to administrate fuel stock and manage the station system operation.

The present invention will now be further explained with reference to preferable embodiments given as mere examples and illustrated in accompanying drawings, in which FIG. 1 is a diagrammatic illustration showing a fuel filling system or station throughout, according to the present invention;

FIGS. 10 to 12 show a fifth type flexible conduit operating mechanism wherein FIG. 10 is a longitudinal sectional view of an elongated body to show a state that a flexible conduit is accommodated in a chamber therefor, FIG. 11 is a right side sectional view thereof, and FIG. 12 is a longitudinal sectional view to show another state that the flexible conduit is completely released from the chamber;

Figure 22:
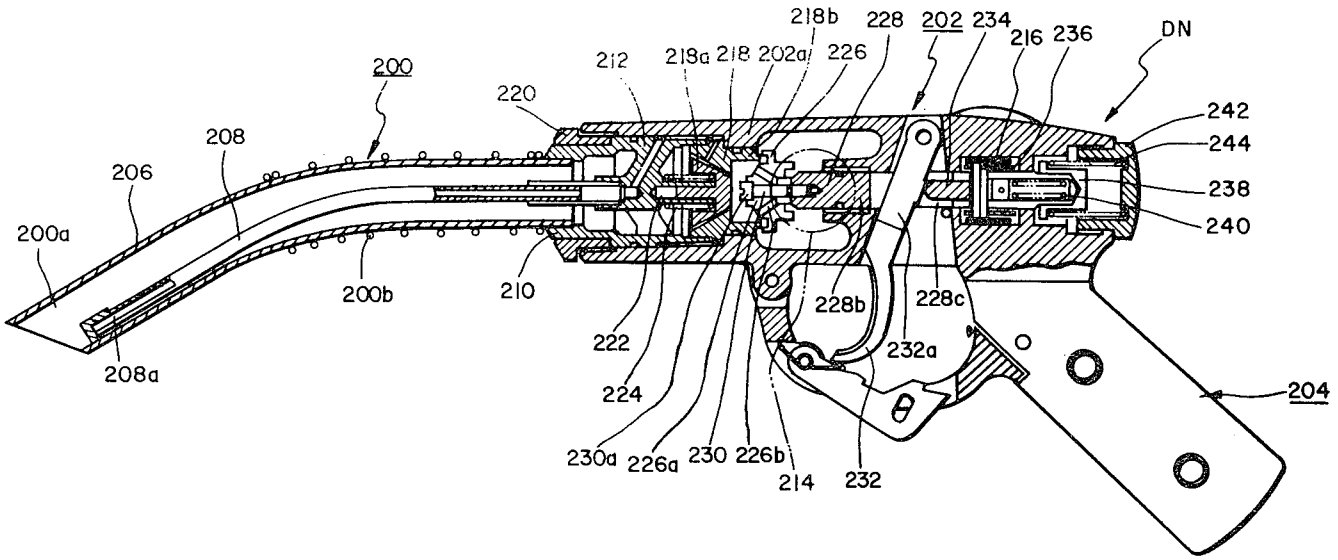
FIG. 22 is a longitudinal fragmental sectional view of a fuel dispensing nozzle.
Figure 23:
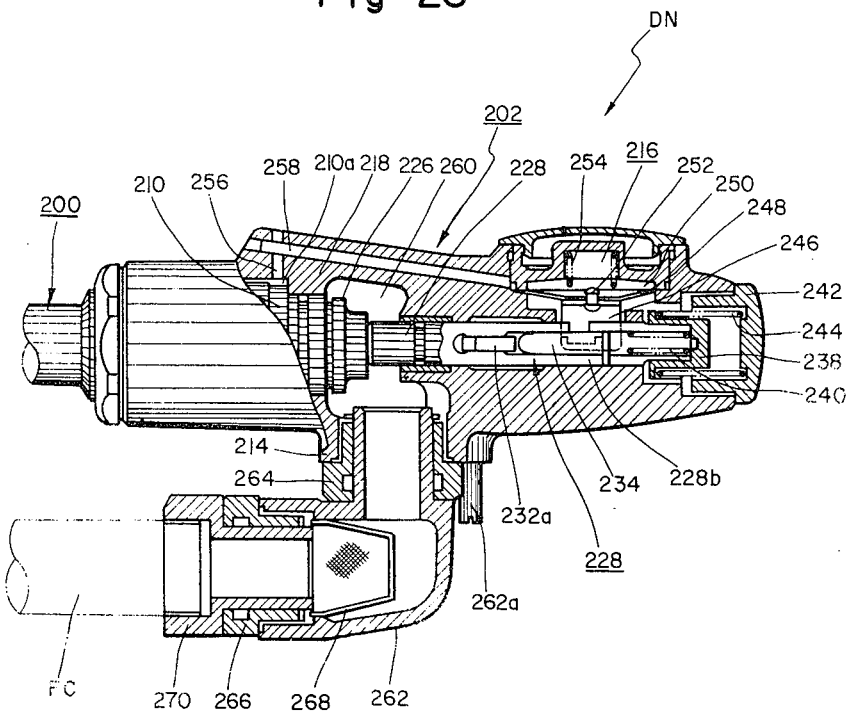
FIG. 23 is an enlarged fragmental partial view of the nozzle as shown in FIG. 22.
Figure 24:
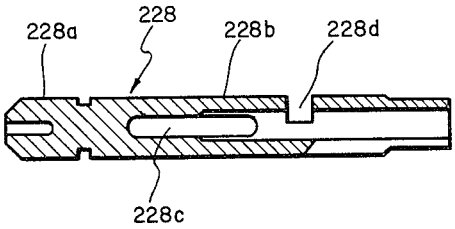
Figure 25:
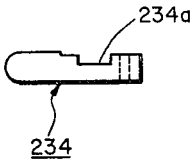
Figure 26:
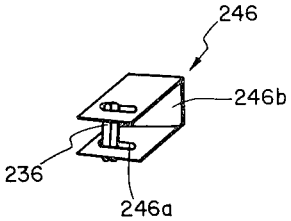
Figure 27:
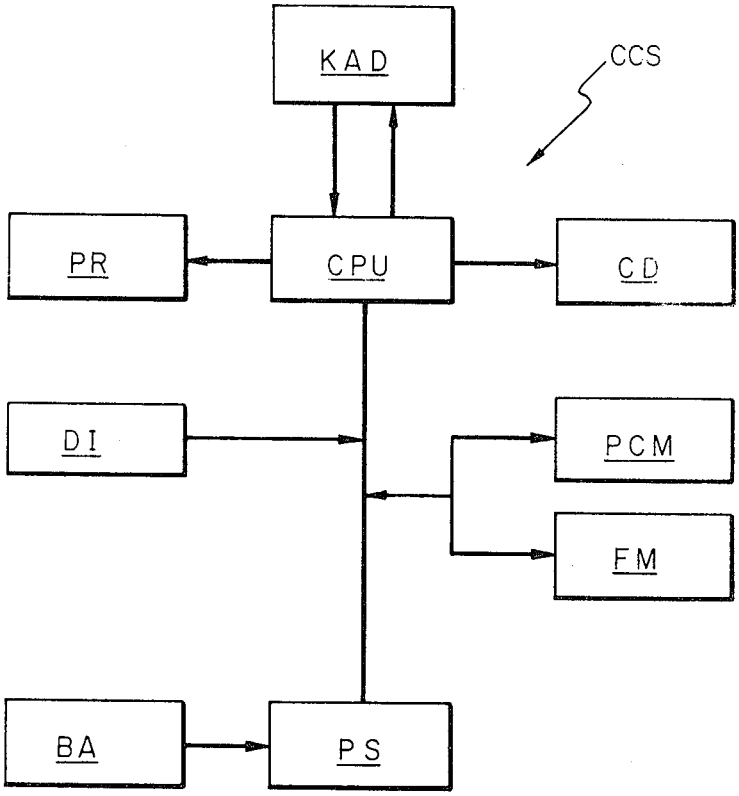

FIGS. 24 to 26 show elements or parts for the nozzle as shown in FIGS. 22 and 23, wherein FIG. 24 is a longitudinal sectional view of a pilot valve, FIG. 25 is a side view of a push rod, and FIG. 26 is a perspective view of a ⊐-shaped frame showing a state that roll pins are inserted therein; and FIG. 27 is a block diagram of a computer control system to be used for the fuel filling system according to the present invention.

Figure 1:
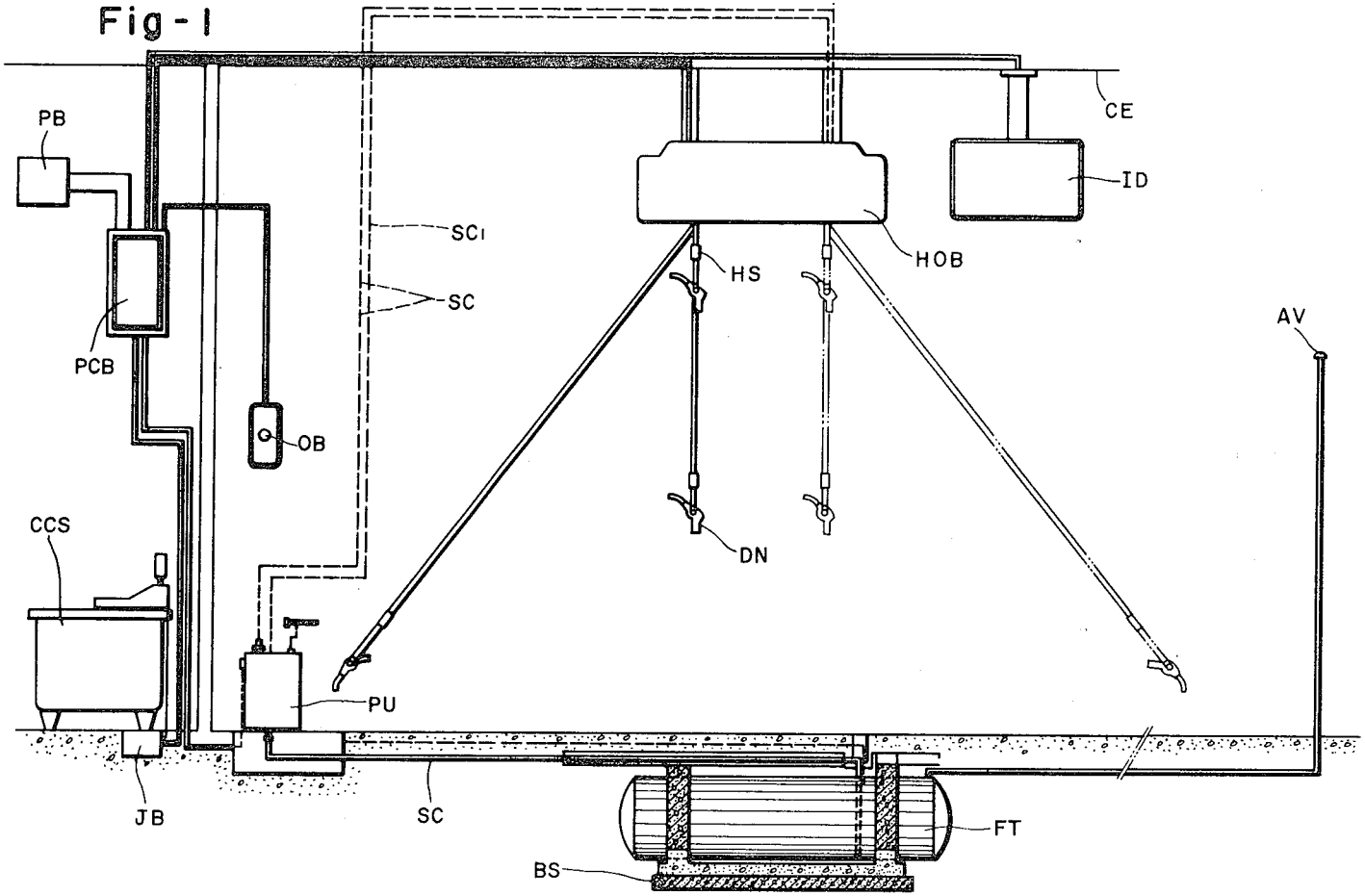

In FIG. 1, there is shown an outline of a fuel filling system or station according to the present invention. The system comprises substantially mechanisms for pumping fuel, indicating an amount of fuel dispensed and, if necessary, a monetary amount corresponding thereto, operating a dispensing conduit, and a means for controlling the mechanisms. The fuel accommodated in a fuel tank FT which is usually arranged under ground on a suitable base structure BS and has an air vent AV can be pumped up by a pumping unit PU to a ceiling CE of the station building through a stationary conduit SC and then dispensed through a dispensing nozzle DN connected through a hand switch HS for continuous fuel supply to one end of a flexible conduit or hose FC, the other end of which is connected to an outlet end of the stationary conduit SC. The pumping unit PU may be a submerged pump (not shown) arranged in the underground fuel tank FT, if the Law allows. The pumping unit PU is electrically connected to an operating button OB through a power control board PCB which is connected to a panel board PB which is in turn connected to an electrical power source (not shown), to a computer control system CCS through a junction box JB, and to an indicator ID for indicating the amount of fuel dispensed and, if necessary, indicating the monetary amount corresponding thereto. Functions of the computer control system CCS shall be referred to later. A body HOB accommodates the flexible conduit FC and a flexible conduit operating mechanism to lower or raise a level of the dispensing nozzle DN in a vertical range of from an upper position near a lower surface of the body HOB to a lower position of waiting for fuel supply and not hindering any passageway for motor cars to be serviced, or to a further lower position for fuel supplying.

Figure 2:
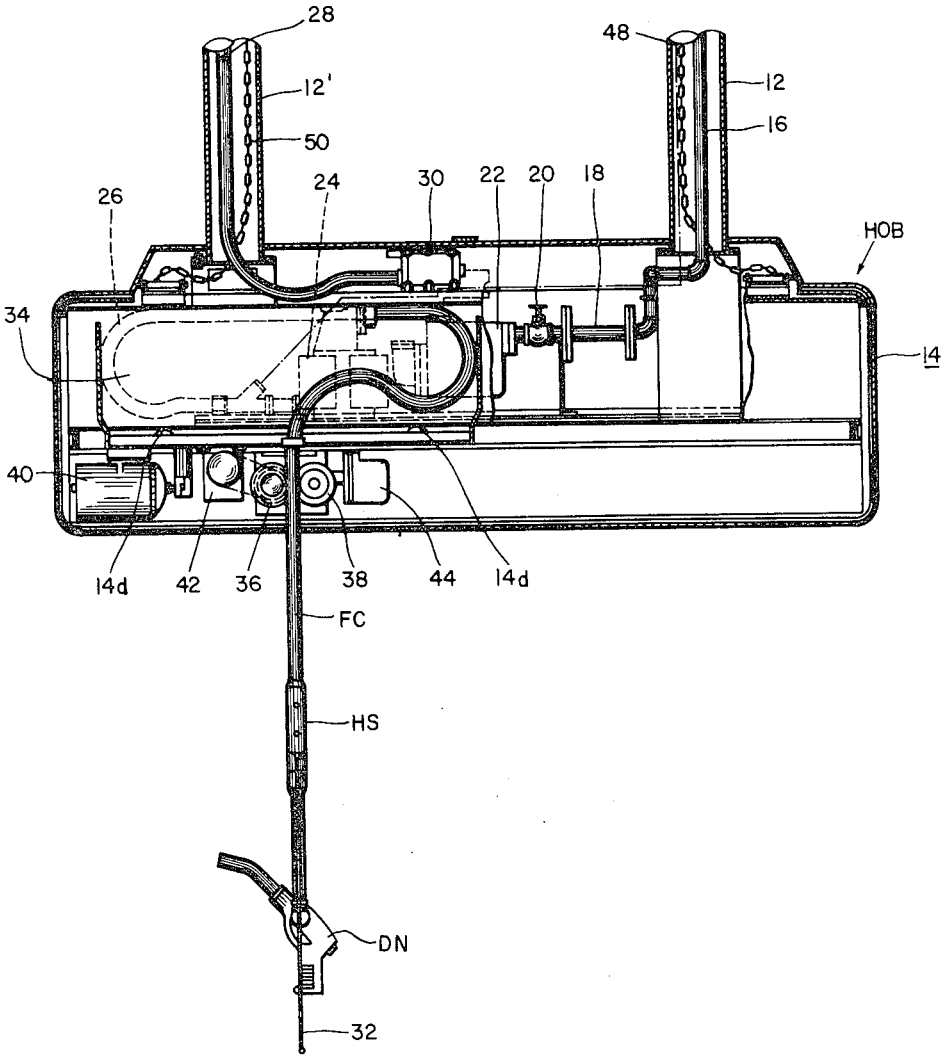
FIG. 2 is a longitudinal sectional view of an elongated body or housing for accommodating a flexible conduit to show a first type flexible conduit operating mechanism.
Figure 3:
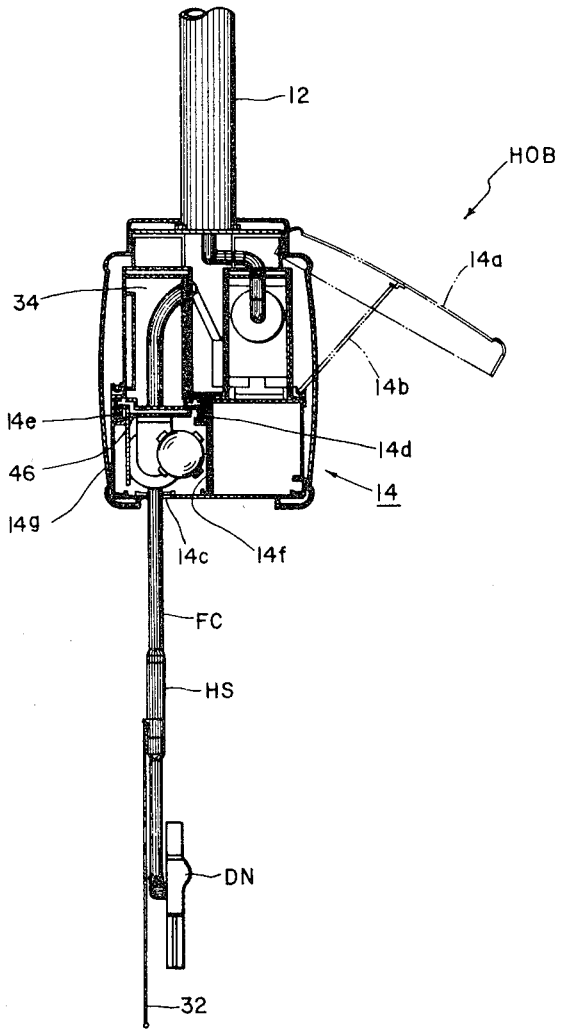
FIG. 3 is a right side sectional view of the body as shown in FIG. 2.

The body HOB suspended from the ceiling CE by legs 12, 12′ or secured directly to the ceiling CE comprises an elongated hollow main body 14 which serves as a guide for motor car drivers approaching the concerned dispensing nozzle DN, as shown particularly in FIGS. 2 and 3. The body 14 has a side panel 14*a* and a panel stay 14*b* for maintaining, if necessary, the side panel 14*a* in open state, so as to make maintenance of mechanisms accommodated in the body 14 easy. The fuel pumped up from the underground fuel tank FT by the pumping unit PU is led to a stationary conduit 16 passing through the hollow leg 12 and dispensed from the dispensing nozzle DN through a flexible tube 18, a valve 20, an air separator 22, a flow meter 24, another stationary conduit 26 and a flexible conduit FC. The air separator 22 is connected to the pumping unit PU to discharge the air possibly contained in the fuel in an atmosphere, through a return pipe SC, (FIG. 1). If the Law allows, the air separator 22 may be arranged separately from the body 14, for instance, by incorporating the same in the pumping unit PU. A member 28 extending through the hollow leg 12′ is an electrical wire, one end of which is electrically connected to the power control board PCB and the other to a joint box 30. From the joint box 30, a leading wire (not shown) extends through the stationary conduit 26 and the flexible conduit FC to be connected to the hand switch HS which has a string 32 for operating the same to further lower the dispensing nozzle DN from its waiting position to its fuel supplying position.

The vertical movement of the dispensing nozzle DN between its upper position near the body 14 and its lower position of waiting or fuel supplying position is carried out by releasing the flexible conduit FC from a flexible conduit accommodating chamber 34 or by accommodating the same in the chamber 34. For this purpose, a pair of rollers or pulleys 36, 38 is provided. The roller 36 is a drive roller driven by a motor 40 through a reduction gearing 42. The actuation of the motor 40 is controlled by a cam switch accommodated in a cam switch box 44 and electrically connected to the joint box 30.

At the bottom of the elongated body 14, there is provided longitudinally a slit 14*c*, through which the flexible conduit FC extends, and the rollers 36, 38, the reduction gearing 42 as well as the cam switch box 44 are mounted on the lower side of a flanged plate 46, edges of which are mounted on rollers 14*d*, 14*e* rotatably arranged on partition walls 14*f*, 14*g* in the body 14, so that by pulling the flexible conduit FC in the longitudinal direction of the body 14, the plate 46 slides to change the position of the flexible conduit FC suspending from the body 14 and to enlarge the fuel filling service area or zone.

In order to avoid a possible falling down of the elongated body 14, it is preferable to provide protect chains 48, 50 each one end of which is secured to a suitable supporting structure (not shown) on the ceiling CE and the other end to a suitable portion in the body 14 (FIG. 2).

Figure 4:
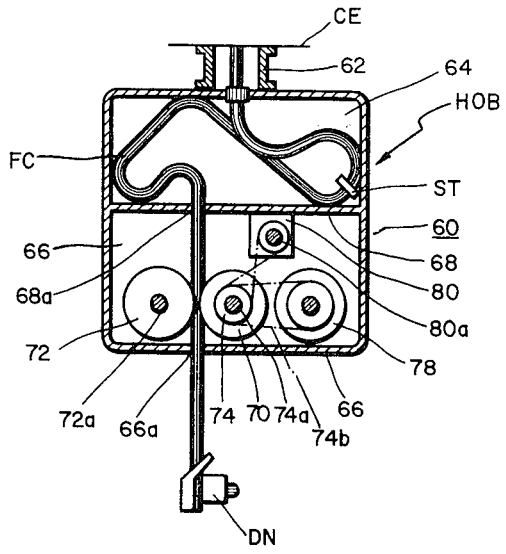
FIG. 4 is a shorter side sectional view of an elongated body to show a second type flexible conduit operating mechanism.
Figure 5:
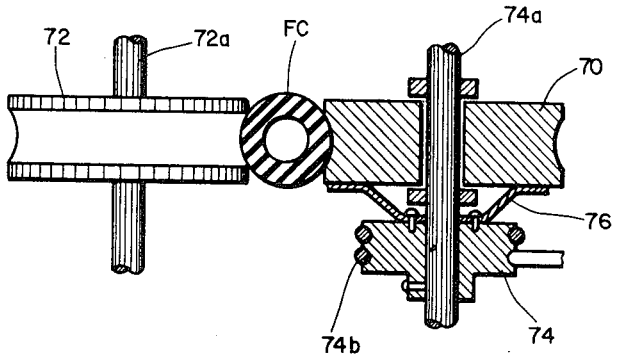
FIG. 5 is an enlarged fragmental sectional plan view showing a mutual relation of a flexible conduit, a driving roller or pulley and an idler roller or pulley as shown in FIG. 4.

FIGS. 4 and 5 show another body HOB with a second type hose operating mechanism. The body HOB comprises an elongated hollow main body 60, although the body 60 is shown in FIG. 4 in vertical cross section. The body 60 is secured to ceiling CE through a connection or leg 62 and divided into two chambers, namely an upper chamber 64 for accommodating a flexible conduit FC and a lower chamber 66 for accommodating a mechanism for operating the flexible conduit FC. The flexible conduit FC, upper portion of which is accommodated in the chamber 64 extends into the lower chamber 66 through an opening or slit 68*a* formed in a partition wall 68, is clamped by a pair of drive rollers or pulleys 70 and a driven roller or pulley 72 and then further extends through an opening or slit 66*a* formed in the bottom wall of the lower chamber 66.

A shaft 72*a* for the driven roller 72 is rotatably journaled to the lower chamber 66. While the drive roller 70 is slidably fitted on a shaft 74*a* for a rotary member 74 rotated within the lower chamber 66 at a predetermined position, and is connected to the rotary member 74 through a friction clutch 76. The rotary member 74 is connected and driven by a drive motor 78 through a transmission means such as a belt 74*b* and is also connected to a rotary shaft 80*a* of a cam switch box 80.

In operation, assuming that the motor 78 rotates in counterclockwise direction in FIG. 4, the rotary member 74 rotates in the same direction to rotate the drive roller 70 through the friction clutch 76, so as to release the flexible conduit FC from the upper chamber 64 with the aid of the driven roller 72. While assuming that the motor 78 rotates in clockwise direction, the flexible conduit is accommodated in the upper chamber 64. A ring like member ST attached to the flexible conduit FC serves as a stopper to prevent an excessive release of the conduit FC.

This embodiment shows advantages in that the flexible conduit FC can be released from the upper chamber 64 in a predetermined length and a wear of the flexible conduit FC due to a compulsory slip thereof to the rollers 70, 72 can be avoided by virtue of the friction clutch 76.

Figure 6:
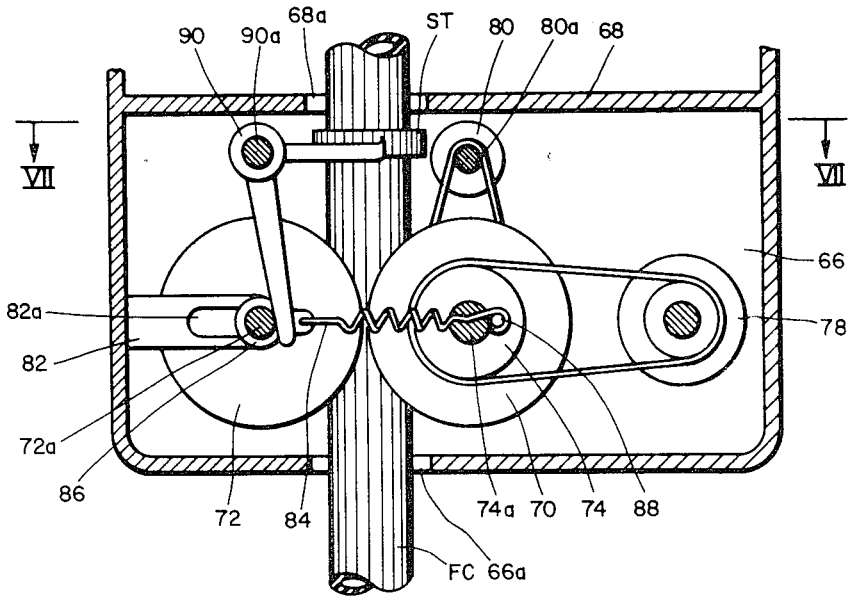
FIG. 6 is a fragmental side sectional view of a part of an elongated body to show a third type flexible conduit operating mechanism.
Figure 7:
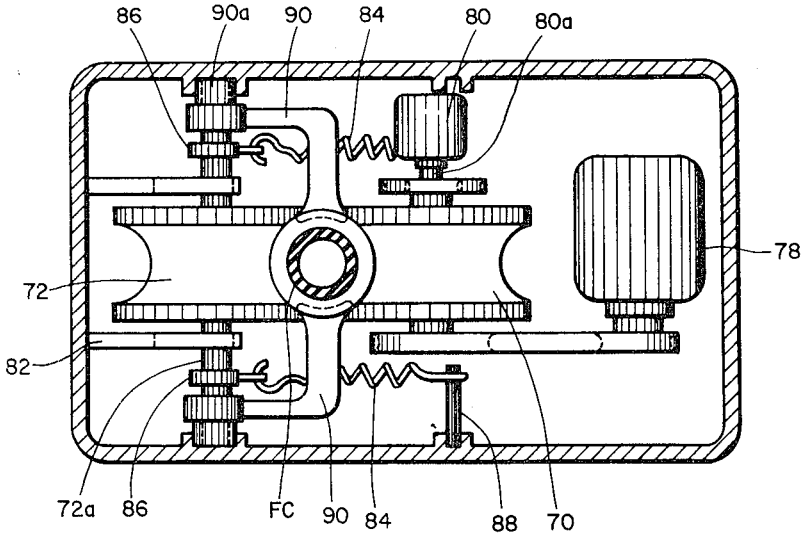
FIG. 7 is a sectional view taken along line VII—VII of FIG. 6.

FIGS. 6 and 7 show a third type mechanism for operating the flexible conduit FC, which may be accommodated in the lower chamber as shown in FIG. 4. This embodiment is substantially same with that as illustrated in FIGS. 4 and 5, excepting that, in lieu of the friction clutch 76, a friction force between a drive roller or pulley 70 and a flexible conduit FC is reduced by a driven roller or pulley 72 to avoid a wear of the flexible conduit FC. In this embodiment, size or diameter of a ring member ST attached to the flexible conduit FC is smaller than that of an opening 68*a* formed in a partition wall 68, and the shaft 72*a* of the driven roller 72 is fitted in slits 82*a*, 82*a* of guide plates 82, 82 without journaled to side walls of the lower chamber 66, so that the space or distance between the shaft 72*a* and a shaft 74*a* of a rotary member 74 may be varied. The drive roller 70 is secured on the shaft 74*a*.

Springs 84, 84 are loaded between ring members 86, 86 loosely fitted about the shaft 72*a* and pins 88 planted on the side wall of the lower chamber 66 and near the shaft 74*a*, to urge the shaft 72*a* toward the shaft 74*a* and to clamp the flexible conduit FC between the rollers 70 and 72.

On a shaft 90*a* journaled to the side wall of the lower chamber 66, there is rotatably mounted bifurcated levers 90, 90, each one arm of which abuts on the shaft 72*a* for the driven roller 72 and the other arm extends to a portion near the periphery of the flexible conduit FC and abuts on the ring member ST when the flexible conduit FC is released from the upper chamber 64 and just before the dispensing nozzle attached to the free end of the flexible conduit FC reaches at its lowest position.

Figure 8:
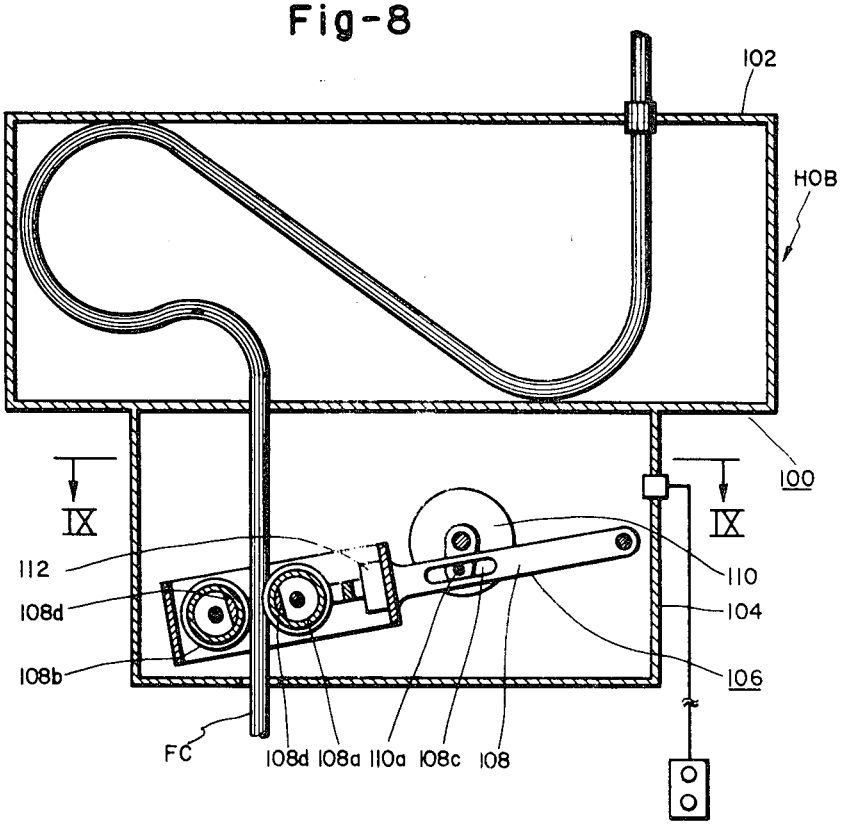
FIG. 8 is a fragmental sectional view of an elongated body to show a fourth type flexible conduit operating mechanism.
Figure 9:
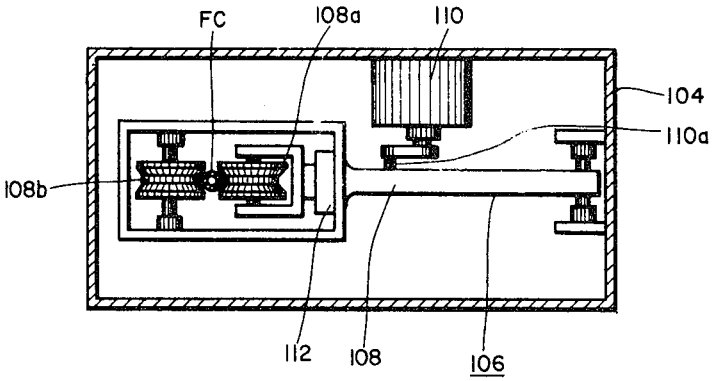
FIG. 9 is a partial sectional view taken along line IX—IX of FIG. 8.

FIGS. 8 and 9 show a body HOB with a fourth type flexible conduit operating mechanism. The body HOB comprises a hollow main body 100 divided into two chambers, namely an upper chamber 102 for accommodating the flexible conduit FC and a lower chamber 104 for accommodating a mechanism for releasing the flexible conduit FC from the upper chamber 102 and accommodating the once released conduit therein. In the lower chamber 104, there is arranged a link-clamp mechanism 106 comprising a swingable member 108. The member 108 is pivoted to the side wall of the lower chamber at one end through a suitable connection and has, at the free end thereof, a driven roller or pulley 108*a* and a drive roller or pulley 108*b* and a slot 108*c* at an intermediate portion thereof to engage with a crank arm 110*a* secured on an output shaft of a motor 110, each of said rollers 108*a*, 108*b* being provided with means 108*d* which allows the rotation of the roller in one direction but prevents rotation in the opposite direction.

In operation for accommodating the flexible conduit FC in the upper chamber 102, the motor 110 is actuated to swingingly move the member 108. In this connection, please note that when the free end of the member 108 moves toward the upper chamber 102, the rollers 108*a*, 108*b* clamp or grasp the flexible conduit FC without rotation and when the free end of the member 108 moves in the opposite direction, the rollers act as idler ones. In order to release the flexible conduit from the upper chamber 102, a solenoid 112 is actuated to release the clamp of the flexible conduit FC by the drive roller 108*b*, so that an operator can manually pull down the flexible conduit FC.

This embodiment has advantages in that the device itself can be manufactured in relatively low cost due to its simple structure and there is no fear of that the flexible conduit gets wavy.

Figure 10:
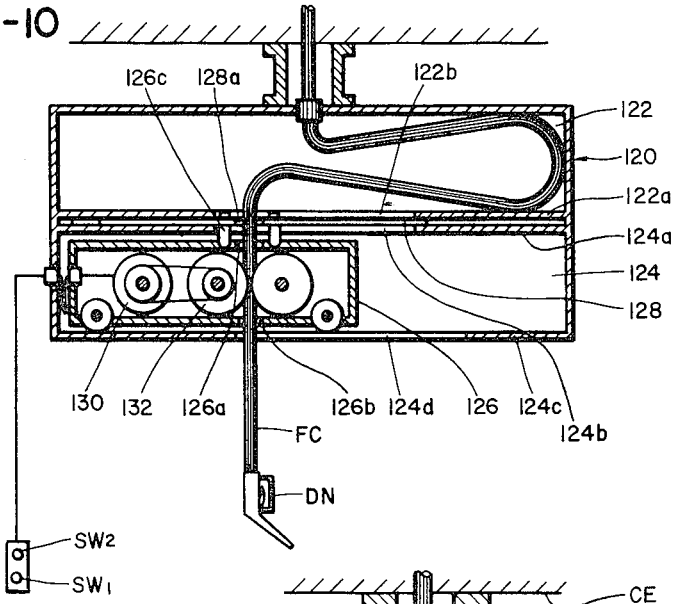
Figure 11:
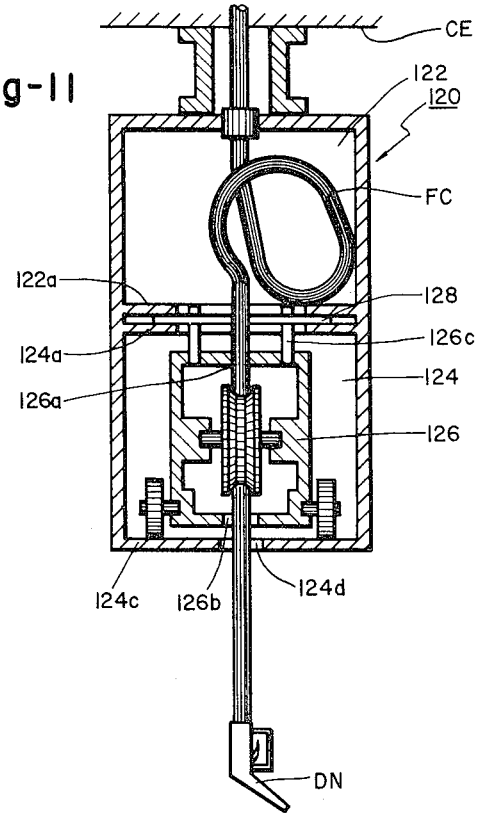
Figure 12:
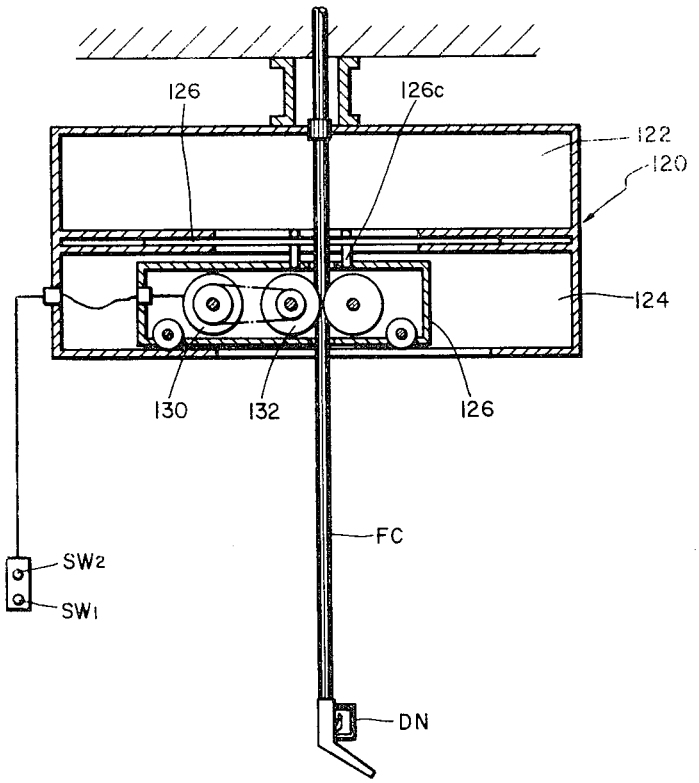

FIGS. 10 to 12 show another embodiment for altering a position where a flexible conduit FC or a dispensing nozzle DN attached to the free end thereof is suspended from an elongated hollow main body 120 for accommodating the conduit FC and a mechanism for operating the conduit FC, so as to enlarge the fuel filling service area or zone.

According to this embodiment, the body 120 is also divided into two chambers, namely an upper chamber 122 for accommodating the flexible conduit FC and a lower chamber 124 for accommodating the flexible conduit operating mechanism. The flexible conduit operating mechanism for accommodating or tucking-up the flexible conduit FC in the upper chamber 122 of the body 120 and releasing the conduit therefrom is placed in a truck member 126 which may run in the lower chamber 124 along its longitudinal axis. The flexible conduit FC accommodated in the upper chamber 122 is led through a long slit **122*b* formed in bottom plate 122*a* of the chamber 122, an opening 128*a* formed in a long slidable plate 128 accommodated in a space defined by the bottom plate 122*a* of the upper chamber 122 and an upper plate 124*a* of the lower chamber 124 to shut the slit 122*b*, a long slit 124*b* formed in the upper plate the lower chamber 124, openings 126*a*, 126*b* formed in the upper and lower plate of the truck member 126, and a long slit 124*d* formed in lower plate 124*c* of the lower chamber 124**.

In operation, FIGS. 10 and 11 show a state of non-actuation of the fuel dispensing apparatus, wherein the flexible conduit FC is accommodated in the upper chamber 122 and thus the dispensing nozzle lies in an upper position. For operating the apparatus, a switch button $SW_1$ is pushed for actuating a reversible motor 130 to rotate a drive roller or pulley 132 in clockwise direction and to release the flexible conduit FC, so that an operator can supply fuel to motor cars by handling the dispensing nozzle DN. If the operator desires to supply fuel to a motor car somewhat spaced from the dispensing nozzle in a longitudinal direction of the elongated body 120, he can pull the flexible conduit FC in such direction to move the truck member 126 (FIG. 12). After having finished the fuel filling operation, the operator can push another switch button $SW_2$ for rotating the motor 130 in a reverse direction to accommodate the conduit into the upper chamber 122. The running movement of the truck member can be made smooth by providing a guide such as upright projections **126*c* which are mounted on the upper plate of the truck member to penetrate the slide plate 128 through the slit 124*c* formed in the upper plate 124*a* of the lower chamber 124**.

Figure 13:
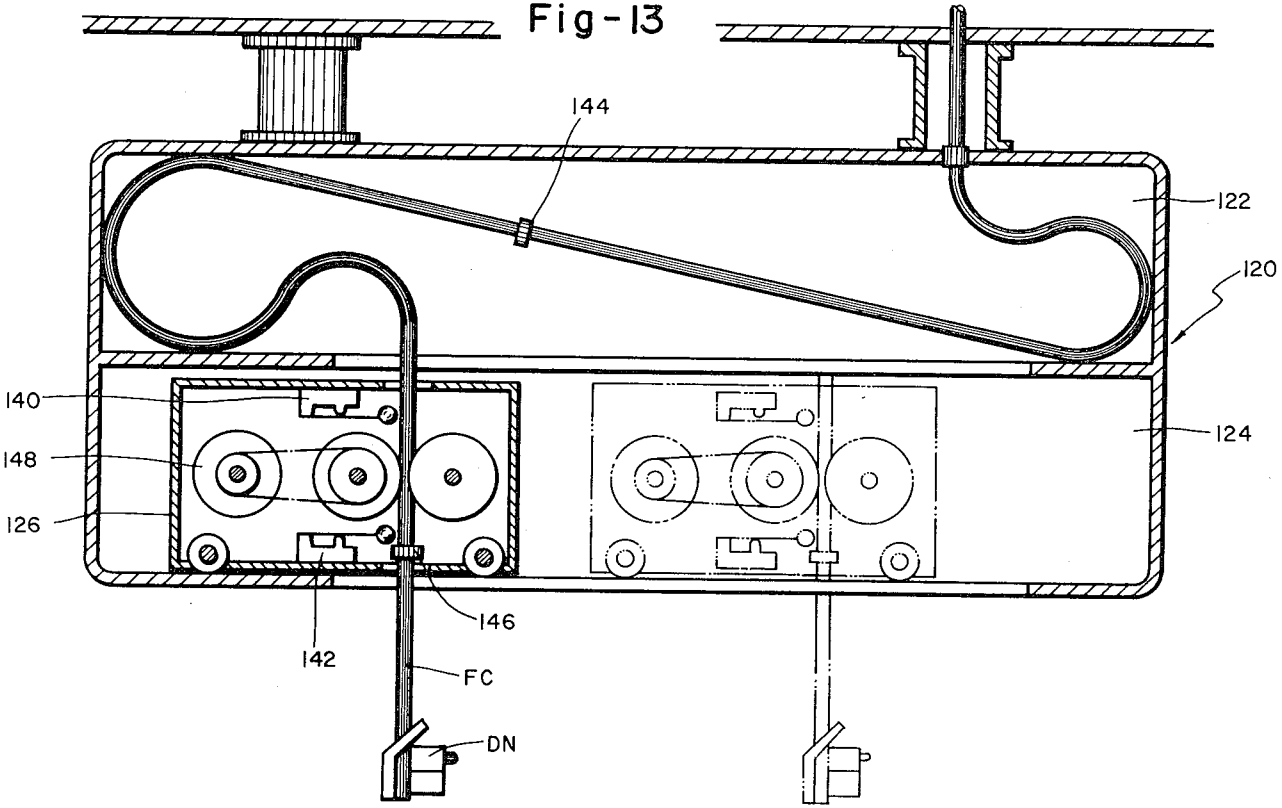
FIG. 13 is a longitudnal sectional view of an elongated body to show a sixth type flexible conduit operating mechanism, wherein a truck member for accommodating the mechanism is movably arranged therein.

FIG. 13 shows the other embodiment for altering the position of a flexible conduit suspended from an elongated hollow body. This embodiment is substantially same with the preceding embodiment as shown in FIGS. 10 to 12, excepting mainly that a safety stopper for the flexible conduit is provided in this embodiment. The stopper comprises two microswitches 140, 142 arranged in a truck member 126 and means 144, 146 attached to the flexible conduit FC to operate the microswitches 140, 142 for deactivating a motor 148 to prevent possible excessive release of the flexible conduit FC from and accommodation or tucking-up thereof into the upper chamber 122.

Figure 14:
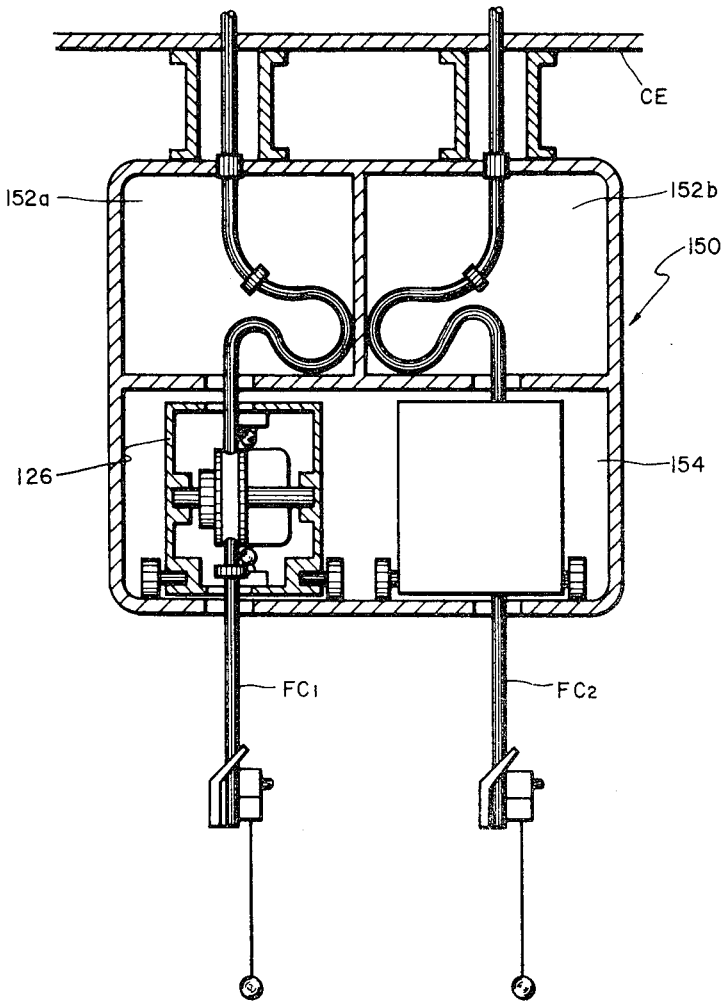
FIG. 14 is a shorter side sectional view of an elongated body, wherein two flexible conduit operating mechanisms are arranged so as to be able to dispense two kinds of fuel.

FIG. 14 shown an elongated hollow body 150 in cross section. The body 150 has three chambers, namely first and second upper chambers **152*a*, 152*b* for accommodating flexible conduit $FC_1$, $FC_2$ and a lower chamber 154 for accommodating mechanisms for operating the respective flexible conduits. The flexible conduit operating mechanisms for this embodiment is substantially same with that as illustrated in FIG. 13 and thus shall not be referred to in more detail. This embodiment has a practical advantage in that either one of two different kind fuels can be supplied to motor cars in same service area or zone. Please note that three or more flexible conduit operating mechanisms may of course be accommodated in only one body 150**, so as to able to supply various kind fuels to various motor cars in substantially same position, and that only one means for indicating an amount of fuel dispensed and, if necessary, indicating monetary amount corresponding thereto may be provided for each box with a plurality of dispensing nozzles, so as to avoid a possible reading mistake by the machine operator and/or the motor car driver, which may be caused when the indicator means indicates various amounts of fuels dispensed from various dispensing nozzles attached to only one body. In this case, when one kind of fuel is dispensed from a specific dispensing nozzle related to the corresponding flexible conduit operating mechanism, the other flexible conduit mechanisms can of course not be actuated.

Figure 15:
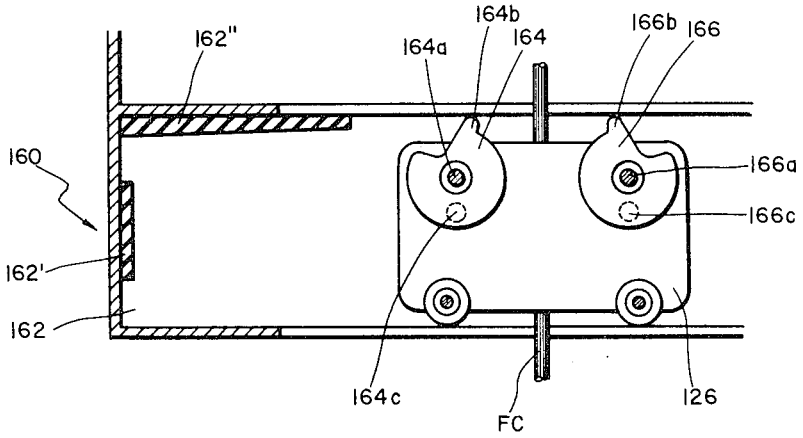
FIG. 15 shows a braking mechanism for the truck member as shown in FIGS. 10 to 14.
Figure 16:
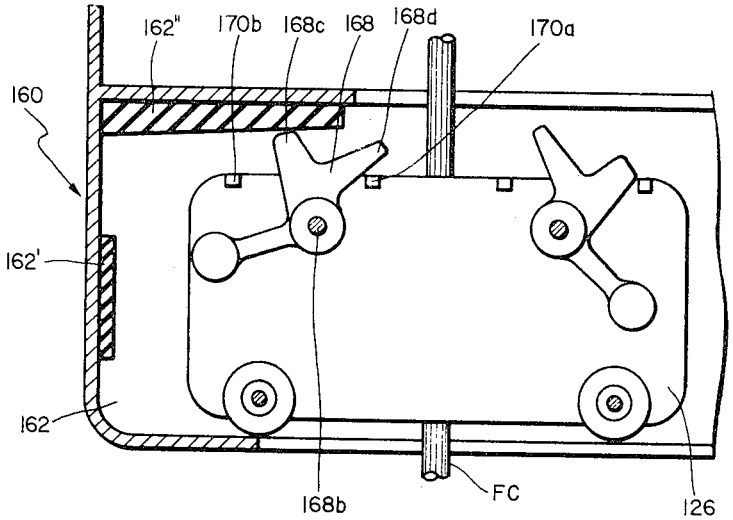
FIGS. 16 and 17 show another type braking mechanism for the truck member as shown in FIGS. 10 to 14, in different states.
Figure 17:
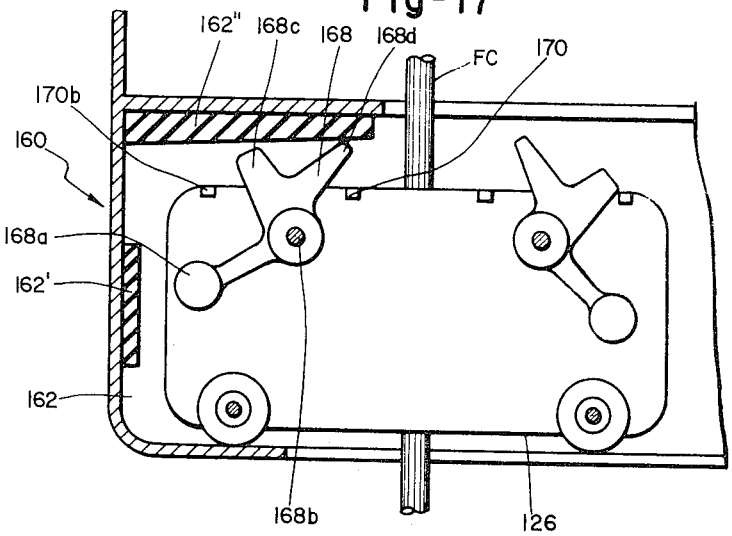

FIGS. 15 to 17 show two embodiments of a mechanism for preventing a possible impact of the truck member 126 (see also FIGS. 10 to 14) to the side wall of a lower chamber 162 of an elongated hollow body 160. When the flexible conduit FC is pulled strongly along the longitudinal axis of the body 160 for the movement of the truck member 126 to change the position of the flexible conduit FC suspended from the body 160, the truck member 126 may over-run to impact the side wall of the lower chamber 162. This generates a relatively large sound and causes a vibration of the body 160 itself suspended through a connection from the ceiling or the like upper structure to give for the operator and customers a restlessness of a falling down of the body 160. The embodiments drive away such restlessness or fear.

According to one of the embodiments, as shown in FIG. 15, the lower chamber 162 has on inner surface of the side plate an elastic member 162' acting as a cushion and on under surface of the upper plate a braking plate 162'' made of an elastic material such as a rubber and having thickness gradually increased toward the side plate and the truck member 126 has two pairs of cam-like members 164, 166 each of which is rotatably mounted on shafts **164*a* 166*a* planted on the side wall of the truck member 126 or penetrated through the truck member 126 and engages with the braking plate 162'' with its projection or ridge 164*b* or 166*b*, when the truck member 126 moves toward the side plate of the lower chamber 162. The cam-like members have, respectively, a balancer or weight 164*c* or 166*c*, so that the projection or ridge 164*b* or 166*b* usually lies in uppermost position of the cam-like member 164 or 166**.

The other embodiment as shown in FIGS. 16 and 17 is substantially same with that as shown in FIG. 15, excepting that the configuration of the member abutting on the braking plate 162'' is different. According to this embodiment, each of the members 168 engagable with the braking plate is formed as a bifurcated crank-like member with a weight **168*a* and mounted on a shaft 168*b* planted on or penetrating through the truck member 126. The bifurcated arms 168*c* and 168*d* extend radially from the shaft 168*b*** in different length, namely the former is shorter than the latter.

The both embodiments as illustrated in FIGS. 15 to 17 have an advantage in that each mechanism shows two different way braking actions, as described hereinafter, to prevent an undesired excessive wear and tear of the braking plate 162'' and the elastic cushion member 162'.

If a machine operator who grasps the dispensing nozzle in one hand and the released flexible conduit FC in the other hand swings or pulls strongly or sharply the flexible conduit FC along the longitudinal axis of the elongated body 160, the truck member 126 runs rapidly toward one of the shorter side of the body 160 or lower chamber 162 together with the flexible conduit FC. Therefore, the projection or ridge 164*b* (166*b*) or the longer arm 168*d* impacts to the edge of the braking plate 162″ to cause rapid rotation of the member 164 (166) or 168 about its shaft 164*a* (166*a*) or 168*b*. As a result, a cam surface 164*d* (166*d*) or tip end of the shorter arm 168*c* abuts on or contacts with the lower surface of the braking plate 162″ to show a sudden and effective braking action. This is clearly shown in FIG. 16 as to the second embodiment. In the second embodiment, there are arranged stoppers 170*a*,170*b* for restricting the rotation of the member 168 about its shaft 168*b* to more effectively attain the braking action. Please remember the fact that the braking plate 162″ has a tapered surface to make the braking action effective due to the plate 162″ and the member 164 (166) or 168.

While, if the operator swings the flexible conduit slowly or in a moderate manner, the truck member 126 runs gradually. In this case, the projection 164*b* (166*b*) or the longer arm 168*d* abuts also on the edge of the braking plate 162″ to cause the rotation of the member 164 (166) or 168, but the cam surface 164*d*(166*d*) or the shorter arm 168*c* does not contact with the lower surface of the braking plate 162″ and thus provides no braking action. This is clearly shown in FIG. 17 as to the second embodiment. In this case, the running movement of the truck member 126 is continued until the shorter side of the truck member 126 abuts on the elastic cushion member 162′.

Figure 18:
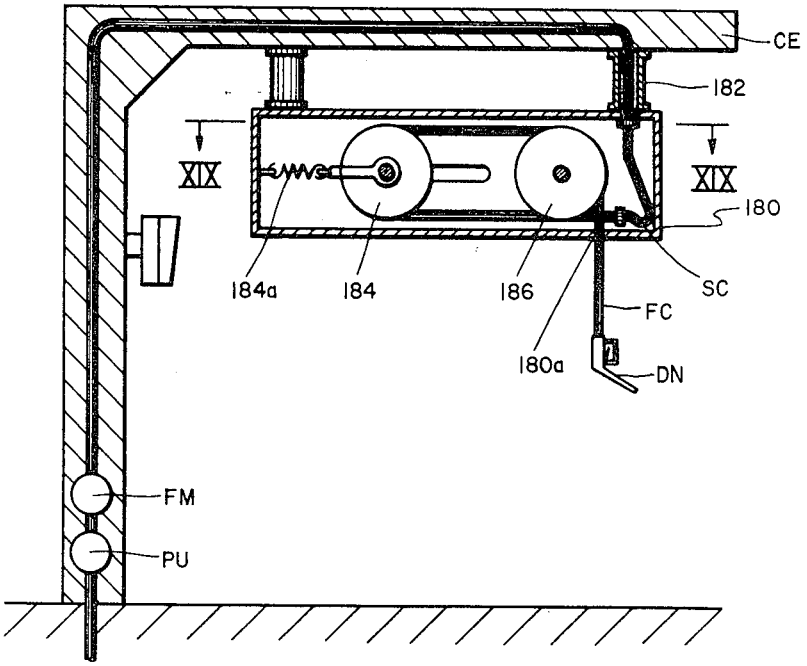
FIG. 18 is a diagrammatic illustration of a fuel filling system or station according to the present invention, to show a seventh type flexible conduit operating mechanism, wherein no prime mover is arranged for operating the flexible conduit.
Figure 19:
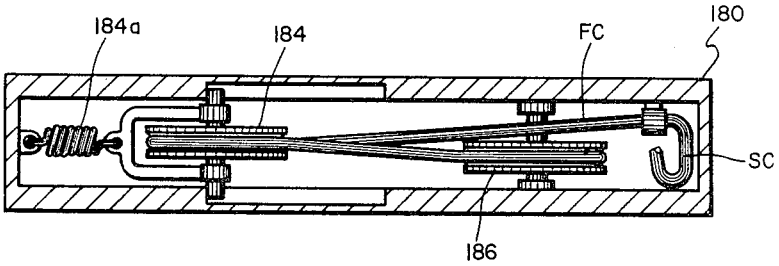
FIG. 19 is an enlarged sectional view taken along line XIX—XIX of FIG. 18.

FIGS. 18 to 21 show two flexible conduit operating mechanisms which are different from the preceding mechanisms in that no electric motor is provided for operating the flexible conduit and that the elongated body is not separated into two or more chambers. As shown in FIGS. 18 and 19, an elongated hollow body 180 is suspended through a suitable connection 182 from ceiling CE or a suitable supporting structure. A stationary conduit SC which is connected directly to a pumping unit PU through a flow meter FM or connected thereto through another stationary conduit extends in the body 180 and is connected to one end of the flexible conduit FC which is led around a spring-loaded movable pulley or drum 184 and a stationary pulley 186 to the outside of the body 180 through an opening or hole 180*a* formed in the lower plate of the body 180, to suspend a dispensing nozzle DN at its free end thereof.

In operation, a machine operator can grasp the lower end of the flexible conduit FC and pull-down the dispensing nozzle DN or the flexible conduit FC to cause movement of the movable pulley against the force of a spring 184*a*, until the dispensing nozzle DN reaches at a position suitable for supplying fuel to motor cars. After having supplied the fuel, the operator may release the flexible conduit FC and the dispensing nozzle DN to allow the dispensing nozzle DN to rise due to the reaction force of the spring 184*a*.

Figure 20:
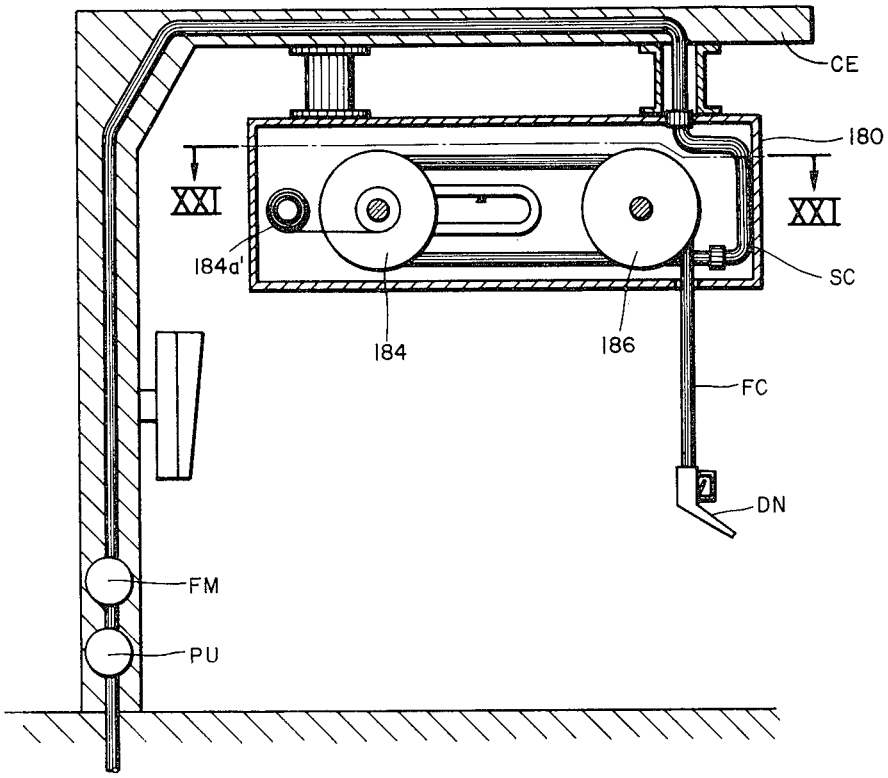
FIG. 20 is a view similar to FIG. 18 but shows a eighth type flexible conduit operating mechanism.
Figure 21:
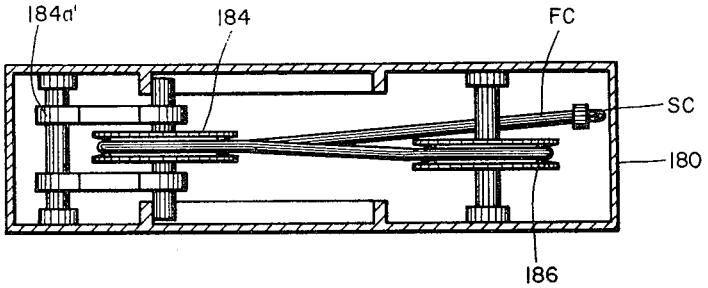
FIG. 21 is an enlarged sectional view taken along line XXI—XXI of FIG. 20.

The embodiment as shown in FIGS. 20 and 21 is substantially same with that as shown in FIGS. 18 and 19, excepting that a constant-torque spring 184*a*′ is loaded for the movable pulley 184 in lieu of the conventional compression spring 184*a* for the embodiment as shown in FIGS. 18 and 19. The constant-torque spring 184*a*′ itself may be a commercially available one to make the force required to lower the dispensing nozzle DN constant, even if the movable pulley 184 lies in any position.

The embodiments as shown in FIGS. 18 to 21 have advantages in that each structure is simple and can easily be installed at a relatively low cost. More particularly, the embodiment as shown in FIGS. 20 and 21 is convenient in that the flexible conduit FC can easily be released and handled at a desired position for dispensing the fuel therethrough, to prevent any trouble due to an excessive local load to the structure which may be caused when the compression spring 184*a* as shown in FIGS. 18 and 19 is employed.

Each of the flexible conduit operating mechanisms as shown in FIGS. 18, 19, and 20, 21 may be arranged in plurality, in a manner similar to the embodiment as shown in FIG. 14, so that two or more different kinds of fuels can be supplied from only one box like fuel dispenser body.

FIG. 22 shows a dispensing nozzle to be used for the fuel dispensing apparatus according to the present invention. In the suspended nozzle type fuel filling system or station, a conventional dispensing nozzle to be employed for the so-called post-like dispensers is not preferable, since, if the conventional nozzle is used, the tip end of the nozzle directs downward to cause drop-down of inflammable fuel such as gasoline remaining therein and to give such a fear to the machine operator and customers that the nozzle may abut on the customer's motor car. Therefore, in the so-called nozzle suspended type fuel filling stations, a dispensing nozzle of the type that the nozzle has a dual rotary joint at a grip portion thereof has been used so that the nozzle can be turned to an upright position parallel to the descending flexible conduit to engage the tip end of the nozzle to a nozzle holder secured with the flexible conduit. However, this conventional type nozzle is not so preferable for a machine operator, since, for operating the dispensing nozzle, he must take actions to disengage the connection of the tip end of the nozzle with the holder, turn the nozzle around the joint, pull trigger of the nozzle for dispensing the fuel, and return the nozzle to engage at the nozzle tip with the holder. This troublesome nozzle operation remarkably decreases the fuel supplying efficiency.

A new type dispensing nozzle DN according to the present invention obviates and overcomes the disadvantages as referred to and encountered in the conventional one, and more particularly improves the handling efficiency thereof. The new type nozzle DN of a pistol like configuration comprises a curved tip portion 200, a main body 202, and a grip portion 204. The tip portion 200 is made from a curved pipe 206 which may be of aluminum pipe and in which an air flow pipe 208 is arranged, so that one end 208*a* of the air flow pipe 208 opens at a lower side of tip end 200*a* of the tip portion 200 and the other end is connected to a central portion of a supporting member 210. A coil element 200*b* mounted on the base part of the tip portion 200 serves to prevent a possible slip-out of the dispensing nozzle DN, when the tip portion 200 is inserted in a fuel inlet opening of a motor car to be serviced.

The main body portion 202 has a front part provided with the air flow pipe supporting member 210 and a valve arrangement 212 near the tip portion 200, an intermediate part provided with a fuel inlet opening 214 at one side thereof, and a rear part provided with an automatic valve closing mechanism 216. A valve seat 218 for the valve arrangement 212 is secured on an inner ridge 202*a* of the tip portion 202 through an O-ring by a securing nut 220 to cover the air flow pipe supporting member 210. A check valve 222 of the valve arrangement 212 is slidably mounted on the air flow pipe supporting member 210 and urged by a spring 224, so that the check valve 222 is urged to fit on a valve seat 218*a* arranged in a down stream of the valve seat 218. A main valve 226 of the valve arrangement 212 is arranged at a flow-in side opposed to the check valve 222 and urged to fit on a valve seat 218*b* by a pilot valve 228 arranged concentrically with the main valve 226. The main valve 226 and the pilot valve 228 are loosely connected with each other by a bolt 230 planted on the pilot valve 228. Between a head 230*a* of the bolt 230 and a hole 226*a* of the main valve 226 for accommodating the bolt 230, there is a gap, so that when the pilot valve 228 slides in right direction (FIG. 22), the pilot valve 228 is open firstly and then the main valve 226 opens.

The main valve 226 has a fine bore 226*b* which serves as a flow passage to down-stream side, when the pilot valve 228 opens.

As shown in FIG. 24, the pilot valve 228 consists of a valve head 228*a* and a cylindrical valve rod 228*b* formed integrally therewith. A trigger 232 (FIG. 22) is inserted in a slot 228*c* formed through the valve rod 228*b*.

As shown in FIGS. 22 to 24, a shank portion 232*a* of the trigger 232 is engaged with a slit 228*d* formed in the valve rod 228*b* through a push rod 234 with a slit 234*a* (FIG. 25) and a roll pin 236, so that by actuating the trigger 232, the valve rod 228*b* moves rightward to open the pilot valve 228 and then to open the main valve 226.

A cap 238 is arranged at the free end of the valve rod 228*b* through a spring 240 to urge the push rod 234 in its position. Further, a second cap 242 is arranged through a spring 244 to urge the valve rod 228*b*, so as to normally close the pilot valve 228.

A member 246 as shown in FIG. 23, more particularly in FIG. 26 is a ⊐-shaped frame with a slot 246*a* to accommodate the roll pin 236. A backplate 246*b* of the frame 246 is connected to a diaphragm 248 arranged in a negative pressure generating chamber 250 by a pin 252. In the negative pressure generating chamber 250, there is arranged a spring 254 which serves to press the diaphragm 248, so that two roll pins 236 inserted in the slot 246*a* of the frame 246 to engage the roll pins 236 with the slit 234*a* of the push rod 234.

The valve rod 228*b*, push rod 234, roll pins 236, frame 246, disphragm 248 and negative pressure generating chamber 250 form together the automatic valve closing mechanism 216.

In FIG. 23, reference numerals 256, 258 represent flow passages for connecting the negative pressure generating chamber 250 to a space passage 260 between the valve seat 218 and pilot valve 228 and for connecting the chamber 250 to a flow passage 210*a* (FIG. 23) of the air flow pipe supporting member 210.

An elbow 262 is rotatably attached to the fuel inlet opening 214 through a fixing nut 264. At flow-in side of the elbow 262, there are rotatably provided through a fixing nut 266 with a strainer 268 and a joint 270 through which the dispensing nozzle DN itself is suspended at the free end of a flexible conduit FC. Reference numeral 262*a* is a stopper pin planted near the fuel inlet opening 214 to prevent an excess rotation of the elbow 262.

According to the new type dispensing nozzle DN as described hereinabove and shown in FIGS. 22 to 26, the fuel inlet opening 214 is arranged at the intermediate part of the main body portion 202 and at one side thereof and connected to the free end of the suspended flexible conduit FC through the elbow joint 262, and further the trigger 232, automatic valve closing mechanism 216 and grip portion 204 are arranged at the rear side of the main body portion 202. Therefore, the centroid of the dispensing nozzle DN itself lies in a rear portion thereof, so that when the dispensing nozzle DN shall be suspended by flexible conduit FC through the elbow joint 262, the tip end 200*a* of the nozzle DN naturally directs upward without using any holder to prevent any drop-out of fuel remaining in the tip portion 200 and to make the nozzle handling for the machine operator easy.

FIG. 27 shows a block diagram of a computer control system CCS to be used for the fuel filling system according to the present invention. The computer control system CCS comprises a central processing unit CPU having a combination KAD of a key board with a display for operator and having a customer display CD, a printer PR, a program control memory PCM, a file memory FM and a dispenser interface DI. The central processing unit CPU operates by an order read out from the program control memory PCM which memorizes operation orders of the computer control system CCS to calculate, judge, position, classify, totalize, transfer data, and control each input and output. The file memory FM accumulates data once treated by the central processing unit CPU. The dispenser interface DI is a circuit for connecting the computer control system CCS to a dispenser control unit (not shown) which control system CCS. The computer control system CCS is actuated by electric power from a suitable power source (not shown) such as usual power transmission line through a power switch PS. BA is a battery which is automatically connected to the computer control system CCS through the power switch PS, when a power interruption of the usual line is caused, to prevent voltage change in a certain time period for securely maintaining the data in such time. The printer PR can print to issue a result processed various data by the central processing unit CPU.

What is claimed is:

1. A nozzle suspended type fuel filling apparatus for dispensing fuel to motor vehicles in a fuel filling service area, comprising an underground fuel reservoir, an elongated hollow body arranged above said fuel filling service area and being of a sufficiently large size to serve as a guide for approaching motor vehicles and thereby define the fuel filling service area, a stationary conduit extending from said underground reservoir to said elongated hollow body, pumping means for pumping fuel from said underground reservoir through said stationary conduit, means dividing said elongated hollow body into an upper compartment and a lower compartment, said lower compartment having a bottom wall with an elongated opening therein, a flexible conduit accommodated in said upper compartment, said flexible conduit having one end portion connected to said stationary conduit and having its other end portion passing from said upper compartment through said lower compartment and exiting through said elongated opening in said bottom wall of said lower compartment, a nozzle means for dispensing fuel connected to the free end of said other end portion of said flexible conduit, operating means in said lower compartment for engaging said flexible conduit for raising and lowering the flexible conduit to thereby withdraw the flexible conduit from said upper compartment during fueling of motor vehicles and to retract the flexible conduit into said upper compartment for accommodating the retracted flexible conduit upon completion of fueling, and slidable means slidably mounted in said lower compartment, said operating means being mounted on said slidable means such that manual pulling of said flexible conduit in the longitudinal direction of said elongated body will effect sliding movement of said operating means as the flexible conduit transverses said elongated opening in the bottom wall of said lower compartment.

2. A nozzle suspended type fuel filling apparatus for dispensing fuel to motor vehicles in a fuel filling service area, comprising an underground fuel reservoir, an elongated hollow body arranged above said fuel filling service area and being of a sufficiently large size to serve as a guide for approaching motor vehicles and thereby define the fuel filling service area, a stationary conduit extending from said underground reservoir to said elongated hollow body, pumping means for pumping fuel from said underground reservoir through said stationary conduit, means dividing said elongated hollow body into an upper compartment and a lower compartment, said lower compartment having a bottom wall with an opening therein, a flexible conduit accommodated in said upper compartment, said flexible conduit having one end portion connected to said stationary conduit and having its other end portion passing from said upper compartment through said lower compartment and exiting through said opening in said bottom wall of said lower compartment, a nozzle means for dispensing fuel connected to the free end of said other end portion of said flexible conduit, and operating means in said lower compartment for engaging said flexible conduit for raising and lowering the flexible conduit to thereby withdraw the flexible conduit from said upper compartment during fueling of motor vehicles and to retract the flexible conduit into said upper compartment for accommodating the retracted flexible conduit upon completion of fueling.

3. A nozzle suspended type fuel filling apparatus according to claim 2, wherein said opening in said bottom wall of said lower compartment is in the form of an elongated slit, and slidable means movable in said lower compartment parallel to said elongated slit, said operating means being mounted on said slidable means such that said operating means is operable to move generally parallel to said elongated slit when said other end portion of said flexible conduit is manually pulled in the longitudinal direction of said elongated body.

4. A nozzle suspended type fuel filling apparatus according to claim 3, wherein said operating means comprises a pair of rollers contacting the outer surface of said flexible conduit, and electric motor means rotating one of said rollers.

5. A nozzle suspended type fuel filling apparatus according to claim 4, wherein said slidable means comprises a slidable plate element, roller elements mounted on said plate element, and partition walls in said lower chamber on which said roller elements are rotatably arranged, said pair of rollers and said electric motor being mounted on said slidable plate element.

6. A nozzle suspended type fuel filling station as claimed in claim 4, characterized in that said one of said rollers is connected to said electric motor through a friction clutch means.

7. A nozzle suspended type fuel filling station as claimed in claim 3, characterized in that the slidable means has a braking means to prevent said slidable means from excessive movement and impacting on a side panel of the lower compartment.

8. A nozzle suspended type fuel filling station as claimed in claim 7, characterized in that said braking means comprises a cam-like lever means with a balancer, which causes a rotation thereof by an abutment on a braking plate arranged on the upper surface of said lower compartment, when said slidable means slides in the lower compartment at a relatively high speed.

9. A nozzle suspended type fuel filling station as claimed in claim 2, characterized in that at least said upper compartment is subdivided into a plurality of chambers, each of said chambers accommodate said flexible conduit for each of different kinds of fuels, said lower compartment accommodating corresponding number of flexible conduit operating means to release the respective flexible conduit from the corresponding chamber, whereby a machine operator can supply one of various kinds of fuels to motor cars by operating one of nozzle means suspended from only one elongated hollow body through respective flexible conduits.

10. A nozzle suspended type fuel filling station as claimed in claim 2, characterized in that said flexible conduit operating means comprises a link-clamp means having a swingable member, a prime mover for driving said swingable member, a pair of roller means which rotate in a direction for grasping said flexible conduit therebetween by actuating said swingable member but not rotatable in an opposite direction to tuck-up said flexible conduit, and a solenoid which is actuated to move one of said roller means away from the other roller means to release said flexible conduit clamped by said both roller means.

11. A nozzle suspended type fuel filling station as claimed in claim 2, characterized in that said flexible conduit operating means is accommodated in a truck member which moves in the lower compartment along its longitudinal axis, said flexible conduit moving vertically through the truck member and slits formed in said upper and lower compartments to lower and raise the nozzle means, whereby a position of said flexible conduit and nozzle means relative to the lower surface of said elongated body can be changed to increase said service area by pulling the flexible conduit in the longitudinal direction of said elongated body.

* * * * *